United States Patent [19]

Rottermann et al.

[11] 4,029,133

[45] June 14, 1977

[54] PROCESS FOR MECHANICALLY EMPTYING POWDERY SUBSTANCES INTO A CONTAINER, AND DEVICE FOR CARRYING OUT THE PROCESS

[75] Inventors: Robert Rottermann, Adliswil; Marcel Rottermann, Gattikon, both of Switzerland

[73] Assignee: Gericke AG, Maschinenfabrik, Regensdorf, Switzerland

[22] Filed: Oct. 17, 1975

[21] Appl. No.: 623,365

[30] Foreign Application Priority Data

Nov. 26, 1974 Switzerland ..... 15660/74

[52] U.S. Cl. ..... 141/12; 141/34; 141/73

[51] Int. Cl.² ..... B65B 1/24

[58] Field of Search ..... 141/283, 114, 325, 326, 141/1, 34, 71, 12, 73, 285, 67; 206/525; 220/93, 256, 259; 217/86

[56] References Cited

UNITED STATES PATENTS 3,509,920 5/1970 Word ..... 141/283

*Primary Examiner*—Houston S. Bell, Jr.

[57] ABSTRACT

A process for mechanically emptying powdery substances into a container, while the filling space rotates during the filling step. The invention relates further to a device for carrying out the process. The device has a cover that can be tightly set upon the filling hole of a container and co-rotates therewith during the filling step. The cover is provided with centrally arranged filling and air outlet channels, forming an annular space with the surrounding cover. The cover is provided with means that increases the filling space volume during filling, and reduces the volume of the filling space by the additional volume after the filling process.

6 Claims, 4 Drawing Figures

FIG.1
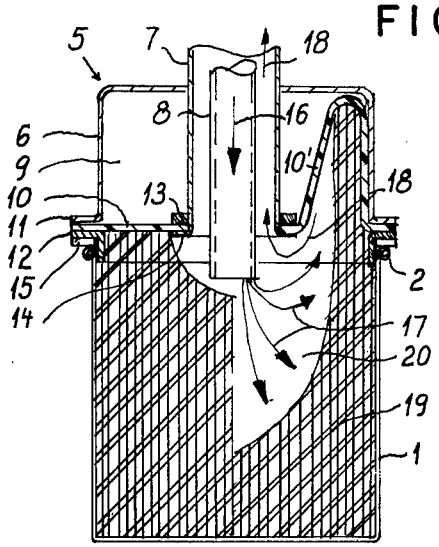
FIG.3
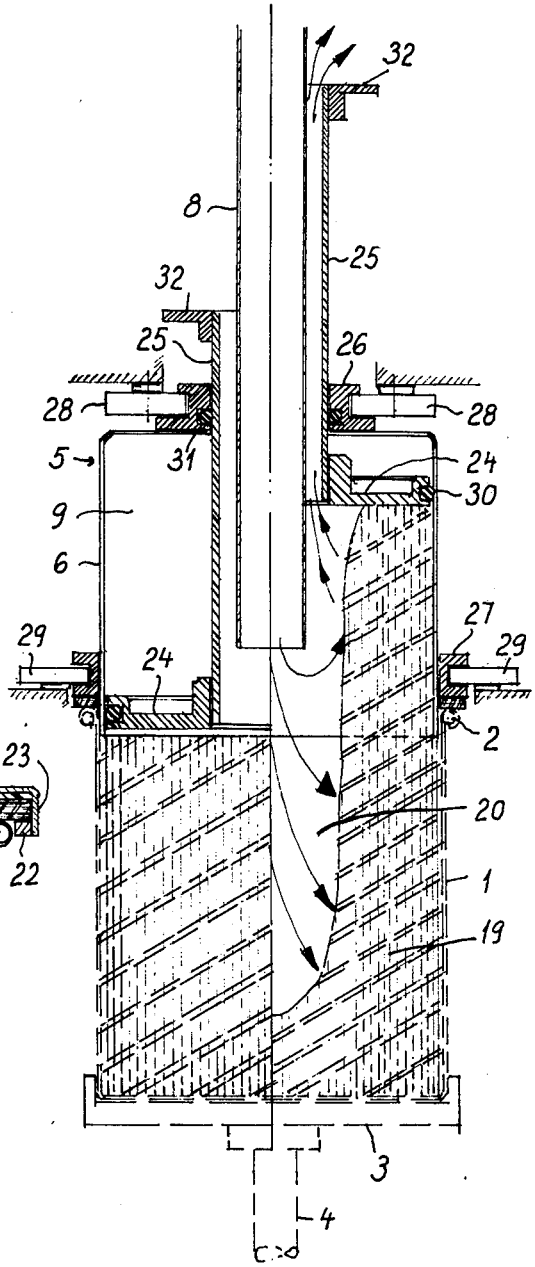
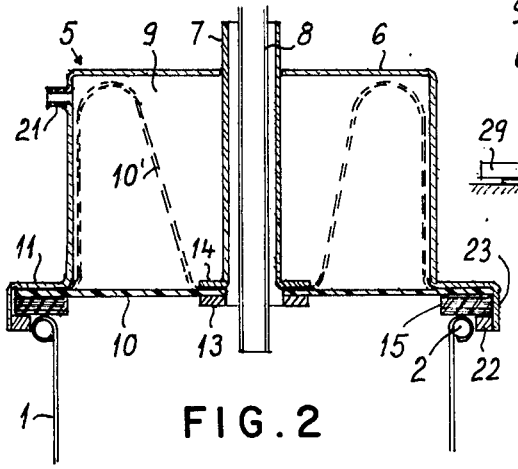
FIG.2
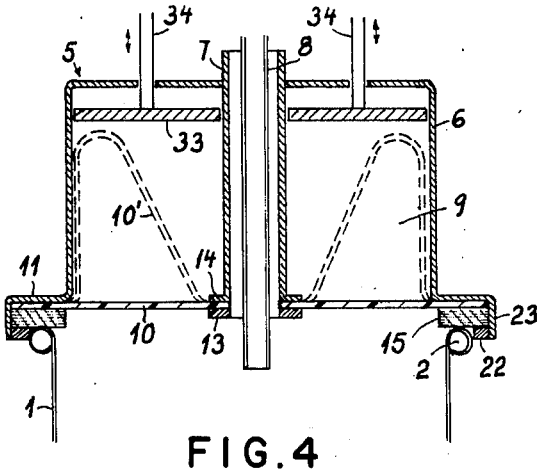
FIG.4

PROCESS FOR MECHANICALLY EMPTYING POWDERY SUBSTANCES INTO A CONTAINER, AND DEVICE FOR CARRYING OUT THE PROCESS

BACKGROUND OF THE INVENTION

1. Field of the Invention

The invention relates to a process for mechanically emptying powdery substances into a container, while the filling space rotates during the filling process. The invention relates further to a device for carrying out the process.

2. Description of the Prior Art

It is known that powdery substances, while moving, e.g. when emptied into a container, have a larger volume than a certain time afterward when the air, trapped in the powdery substance, has escaped. This disadvantage can be eliminated in a known way by setting the container into rotation, for example during the filling process, according to the Swiss Pat. No. 429,555. The filling material is then separated and compressed under the effect of the centrifugal force.

Known processes for emptying powdery substances into a rotating container are, however, imperfect, since the effect of the centrifugal force cannot be maintained until the container has been completely filled, and then a part of the filling substance streams away through the aerating channels in the final phase of the filling process.

SUMMARY OF THE INVENTION

This insufficiency of the known processes can be eliminated so that the filling substance according to the invention is introduced during the filling process in a quantity corresponding to a nominal volume of the container and enters into a filling space that is enlarged in comparison with the nominal volume of the container by an additional volume. The filling substance is compressed after the filling process to the nominal volume of the container.

Since the filling space is larger than that of the substance to be filled, a central hollow space remains even at the end of the filling process, such that the centrifugal force can act upon the filling substance up to the last amount to be filled.

The device according to the invention for carrying out the process is characterized in that it has a cover that can be tightly set upon the filling hole of the container and co-rotate with the container during the filling process. The container is provided with centrally arranged filling and air outlet channels, disposed interiorly of the annular space occupied by the rotating substance. The container also has means that reduce the volume of the filling space by the above-mentioned additional volume after the filling process.

This reduction of the volume has the effect that the hollow space, formed by the outward displacement of the filling substance by centrifugal force, no longer exists. Additionally, the filling material is subjected to a movement within itself, while, due to the strong compression of the filling material during the rotation, the tendency to form clods is counteracted.

The invention will now be described in detail with reference to the accompanying drawings representing preferred embodiments of the invention. In the drawings:

FIG. 1 shows a preferred embodiment of the invention in cross-section;

FIG. 2 shows an alternative arrangement of the top of the container of FIG. 1;

FIG. 3 shows another alternative arrangement of the top of the container of FIG. 1; and FIG. 4 shows yet another alternative arrangement of the top of the container of FIG. 1.

DESCRIPTION OF THE PREFERRED EMBODIMENTS

Examples of embodiments of the device according to the invention are schematically illustrated in the drawing. FIGS. 1 to 4 show each in longitudinal section an embodiment of the part of the device cooperating with the container for filling containers of a rigid construction. The embodiments differ by various means for reducing the volume of the filling space by an additional volume after the filling process is completed. In FIGS. 1 and 3, the right half of the figure represents the state at the end of the filling process, and the left side of the figure shows the state after the compression of the filling material.

In all represented examples of the embodiment, the container is a cylindrical container 1, open at its top, of rigid construction, and with a bordered edge around an opening 2. The container 1 lies during the filling process, for example according to FIG. 3, on a co-rotating plate 3, rotated around its axis 4, for example by an electric motor.

According to FIG. 1, a cover 5 is tightly set upon the filling opening of the container 1. In the center of the cap-part 6 of this cover 5 and firmly connected with it, a tube 7 is arranged enclosing a longitudinally moving but not rotatable filling tube 8. The free space between the tube 7 and the filling tube 8 serves as an air outlet channel. The cap-part 6 of the cover 5 forms, outside the tube 7, an annular space 9. The annular space 9 is closed against the container space by an elastic, circular membrane 10 which is clamped on its outer edge between a flange 11 of the cap-part 6 and the flange part of a centering ring 14 of the tube 7 and a damping ring 13. The cylindrical part of the centering ring 12 enters into the opening of the container, and beneath the flange part of the centering ring 12 is a sealing ring 15, arranged seated upon the opening edge 2 of the container 1 and seals the filling space.

During the filling process, the container 1 rotates together with the cover 5 and the tube 7. The filling material, mixed with air, is directed through the filling tube to the filling space (arrow 16). Under the effect of centrifugal force, the filling material/air mixture is separated and the filling material is deposited on the periphery of the filling space (arrows 17) and compressed, while the air flows away through the air discharge channel (arrows 18).

The elastic membrane 10 is pressed under the pressure of the filling substance 19 into the annular space 9 (right half of FIG. 1), whereby the filling space is enlarged so that, at the end of the filling process, when the filling space has received the respective amount of filling substance according to the nominal value of the container, a central hollow space 20 remains and thus a centrifugal force can also be still acting on the last part of the filling mass. After the filling process, when the rotary aggregate 1, 5, 7 is again at a standstill, the tensioned membrane 10 can return into its resting position and presses then automatically the filling material 19 placed in the annular space into the container 1, whereby the greatest part of the hollow space 20 no longer exists (left half of FIG. 1).

FIG. 2 shows a similar form of embodiment of the device as FIG. 1, where the same parts are equally marked. The main difference consists in that compacting of the filling substance is enhanced here after the filling process by the effect of outer forces from the annular space 9 into the container 1. A liquid or gaseous pressure means is introduced for this purpose through an opening 21 in the cover 5 that enhances the compressing force of the taut membrane 10'. A centering ring 22 is further placed on the inner side of a marginal shoulder 23 of the cap-part 6 of the cover 5, and the sealing ring 15 is inserted between the flange part 11 of the cap-part 6 and the centering ring 22.

In the form of embodiment according to FIG. 2, there is also the possibility to pull up the membrane 10 before the filling process into a position marked by 10' by producing a vacuum in the annular space 9. After the filling process, the air is removed from the annular space and the filling material is pressed by the compressing force of the taut membrane 10 from the annular space 9 into the container 1. This restoring of the membrane 10 and of the filling matter can be effected with or without support by means of a pressure medium introduced into the annular space 9.

Another form of embodiment of the device in which the filling substance is equally compressed after the filling process by the effect of outer forces from the annular space 9 into the container, is shown in FIG. 3. Instead of the membrane actuated by the pressure medium, an annular piston 24 is provided here that closes the annular space 9 and retreats during the filling process under the pressure of the filling substance 19 into the annular space 9, or is retracted by an outer power effect (right half of FIG. 3). After the filling process, the filling substance is pressed by this annular piston 24 from the annular space 9 into the container 1 (left half of FIG. 3).

The annular piston 24 sits on the bottom end of a tube 25, supported so as to be longitudinally displaceable in the cover 5, having otherwise the same function as the tube 7 in FIGS. 1 and 2. The cover 5 is equally designed relative to its connection with the container 1 as the one according to FIG. 1 and is guided in this example radially and axially. Bearing rings 26 and 27, cooperating with the stationarily supported runners 28, and 29, respectively, placed above and below the cover 5 on the cap-part 6, serve this purpose. A sealing ring 30 serves for sealing the annular (ring) piston 24 against the inner coat surface of the cylindrically or prismatically designed cap-part 6. A further sealing ring 31 seals the longitudinally moving tube 25 against the bearing ring 26. The outer force for moving the annular piston 25 can be applied to, for example, a flange 32 on the upper end of the tube 25.

In the example according to FIG. 3, the filling tube 8 does not need to reach to the container 1. This has the advantage that the container 1 can be completely filled or even slightly overfilled, while, in the latter case, the part of the filling substance, extending over the opening edge 2 of the container, is pressed when the container is closed, through a cover, provided for this purpose, into the container.

A fast, complete, and compact filling of such containers with a practically dust-fee air exhaust is thus obtained.

The container 1 may be also designed in a prismatic or any other shape. It is essential that the rotatable cover 5 fits into the filling opening of the container.

The form of embodiment according to FIG. 4 is similar to that according to FIG. 2. The membrane 10 which takes the position marked by 10' when taut, will however be repelled, together with the filling material placed in the annular space 9, by an annular piston 33 that is actuated from the outside by the pushrods 34. A so called rolling membrane, that has cord inserts arranged in concentric circles, serves as a membrane 10. A complete emptying of the pocket formed by the membrane is thus realized.

The described device can be further applied also for filling shapewise unstable (non-rigid) containers, such as bags or sacks, and examples are cross-bottom bags or cement bags. A filling process with a co-rotating, supporting shape for the reception of the container can be provided for this purpose. The container 1 represented in the drawing could for example serve as a supporting shape. The bag for filling the container 1 could be inserted in this case, and the opening edge of the bag could be clamped between the edge of the opening 2 of the container 1 and the cover 5.

The piston face of the annular piston 24 can be conical, for example, so that it is directed inwardly or outwardly and, in case of pressing down the annular piston, the filling material presses inwardly or outwardly, respectively.

From the foregoing, it can be readily realized that this invention can assume various embodiments. Thus, it is to be understood that the invention is not limited to the specific embodiments described herein, but is to be limited only by the appended claims.

What is claimed is:

1. A process for mechanically emptying powdery substances into a rotating container wherein the filling space rotates during the filling process, characterized by the steps of:

introducing said substance in an amount corresponding to the nominal volume of the container into a filling space;

simultaneously enlarging said filling space by an additional volume, during rotation of said container in comparison with the nominal volume of the container; and subsequently compressing said amount of said substance into the container by reducing said filling space by said additional volume.

2. A device for mechanically emptying powdery substances into a rotating container, comprising:

a cover that can be tightly seated upon the filling opening of the container, said cover co-rotating with the container during filling of the container;

a centrally arranged air discharge channel through said cover;

a filling tube arranged with its outlet disposed centrally of said container;

a movable barrier between said cap and the container, said barrier and said cap defining an additional volume to contain a portion of said substance during the filling of the container, said barrier being movable downwardly to reduce said additional volume; and means to move said movable barrier.

3. A device according to claim 2, wherein said cover forms an annular space about said filling tube, and wherein:

said movable barrier comprises an elastic membrane which closes the annular space; and said means for moving said movable barrier comprises means to force said filling substance into said annular space under pressure.

4. A device according to claim 3, wherein said means to move said movable barrier further comprises an annular piston contained in said annular space, by which the filling substance is pressed from the annular space under said membrane into the container.

5. A device according to claim 2, wherein the cover has a co-rotating supporting member for rotatably supporting a container of a non-stable shape.

6. A device according to claim 2, wherein said movable barrier comprises an annular piston.

* * * * *